US007752957B2

(12) United States Patent
Chrupalla et al.

(10) Patent No.: US 7,752,957 B2
(45) Date of Patent: Jul. 13, 2010

(54) HYDRAULIC MOTOR

(75) Inventors: Jean-Claude Chrupalla, Vaureal (FR); Pascal Hugues, Orvault (FR)

(73) Assignee: Alfa Laval Moatti, Les Clayes-Sous-Bois (FR)

( * ) Notice: Subject to any disclaimer, the term of this patent is extended or adjusted under 35 U.S.C. 154(b) by 388 days.

(21) Appl. No.: 11/957,220

(22) Filed: Dec. 14, 2007

(65) Prior Publication Data

US 2008/0148932 A1 Jun. 26, 2008

(30) Foreign Application Priority Data

Dec. 19, 2006 (FR) ..... 06 55616

(51) Int. Cl.
*F03C 1/007* (2006.01)
*F15B 15/08* (2006.01)

(52) U.S. Cl. ..... 91/286; 91/227; 91/218; 91/340

(58) Field of Classification Search ..... 91/224, 91/227, 281, 286, 340, 341 R
See application file for complete search history.

(56) References Cited

U.S. PATENT DOCUMENTS

| | | | | |
|---|---|---|---|---|
| 456,128 | A | 7/1891 | Darling | |
| 3,869,928 | A | 3/1975 | Ishii et al. | |
| 4,373,425 | A | 2/1983 | Moatti | |
| 7,162,944 | B2 * | 1/2007 | Britz | 91/227 |

FOREIGN PATENT DOCUMENTS

| | | |
|---|---|---|
| DE | 169 074 | 4/1906 |
| EP | 0 022 021 A1 | 1/1981 |

* cited by examiner

*Primary Examiner*—Thomas E Lazo
(74) *Attorney, Agent, or Firm*—The Webb Law Firm

(57) ABSTRACT

A hydraulic motor with rotating shaft coupled to a piston with alternating rectilinear displacement. The hydraulic motor comprises a casing enclosing a rotating shaft, a piston and an inverter comprising a first sleeve formed as one piece with the piston, a second sleeve, fixed in position, and a distributor mounted so as to rotate in the interior of the second sleeve and conduit and hole elements arranged between the second sleeve and the distributor and means for controlling the rotation of the distributor as a function of the displacement of the first sleeve so as to invert the direction of displacement of the piston.

7 Claims, 3 Drawing Sheets

FIG.1
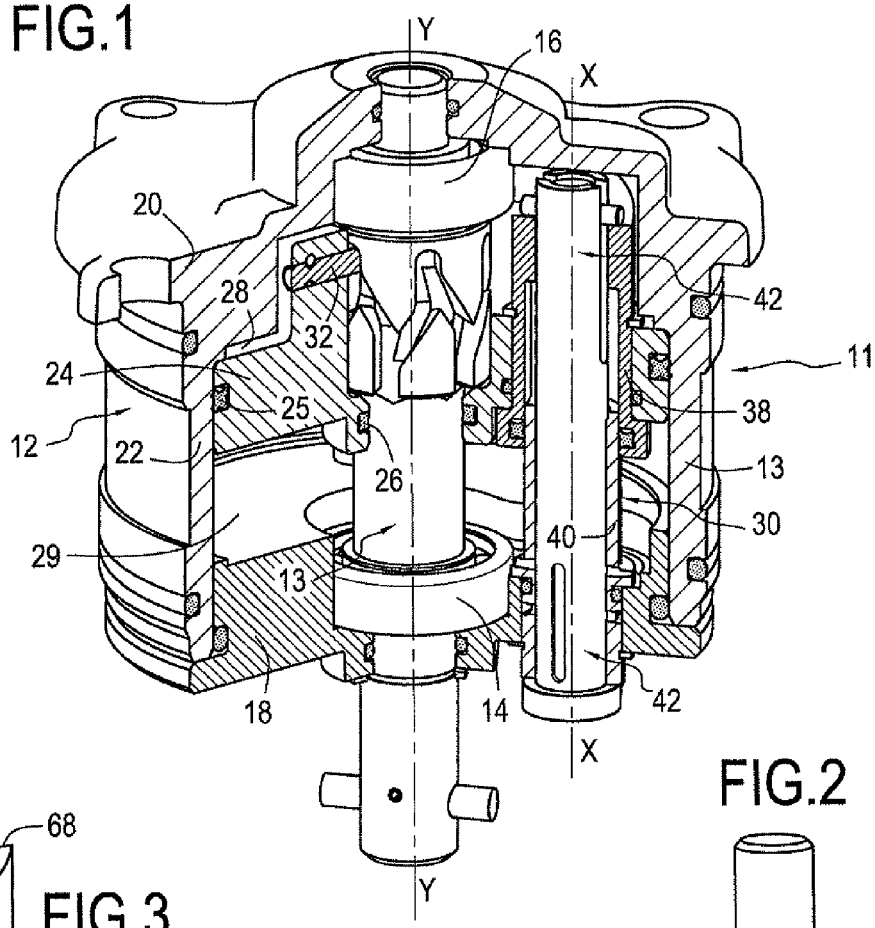
FIG.2
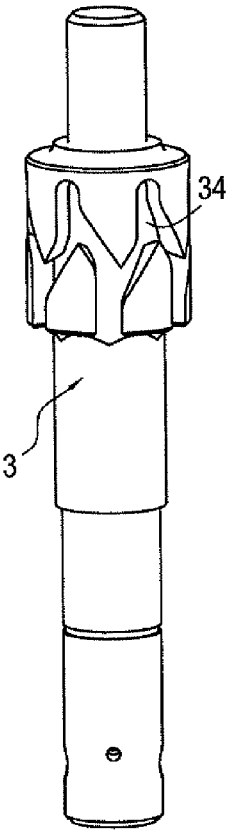
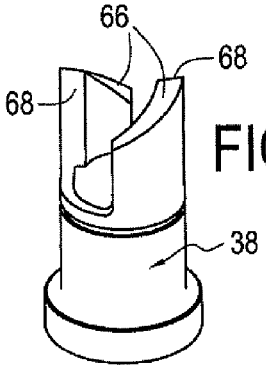
FIG.3
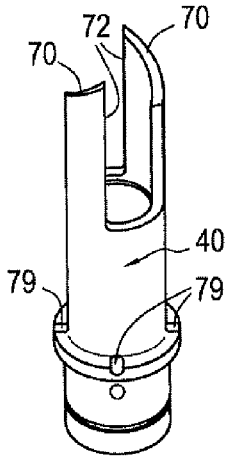
FIG.4
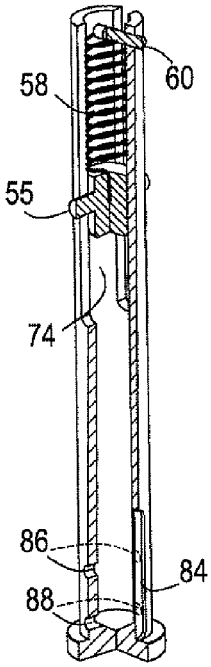
FIG.5
FIG.6
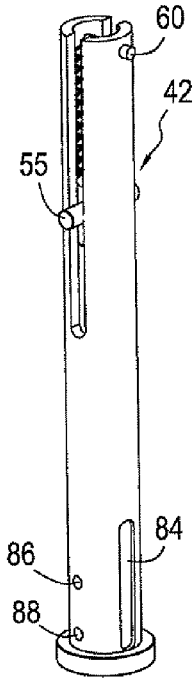

HYDRAULIC MOTOR

The invention relates to a hydraulic motor of the type comprising a casing through which passes a rotating shaft coupled by movement conversion means to an alternating rectilinear displacement piston, capable of movement inside the casing and mounted so as to slide along the length of the shaft. The invention concerns in particular the structure of an inverter capable of controlling alternately and sequentially the refilling of one chamber and the emptying of the other in order to ensure an alternate movement of the piston and, consequentially, the rotation of the shaft.

In the context of automatic cleaning filters using counter-flow circulation of the fluid filtered across an isolated sector of the filter, it is necessary for the isolating system to be caused to turn in order to achieve a continuous cleaning of the filtering surface.

In order to cause the isolating system to turn, it is advantageous to have available a hydraulic motor which uses for its function a small part of the fluid filtered by the filter which it serves, without the provision of external energy.

Such a motor must comprise a power unit which allows for the hydraulic energy of the fluid to be transformed into mechanical energy, more particularly into a practically continuous rotational movement and always in the same direction, in order to actuate the isolating system of the filter on which it is installed. The motor must also comprise a control part which includes the whole of the functions and the circuits allowing for the supply and distribution of the fluid of the motor, in order to ensure its proper function.

European Patent 0 022 021 describes a hydraulic motor with alternating piston and ratchet, in which the alternating displacement of the piston incurs a continuous rotation in the same direction of an output shaft. The whole of the control function is ensured by external distributors and by inversion relays. This type of motor is advantageous because the speed of rotation is well-suited to the intended application, the torque is substantial and it is capable of operating at low pressure. In addition to this, the consumption of fluid is low and the delivery is good. On the other hand, such a system requires a large number of components, particularly for the function of controlling the inversion of the actuating fluid. Its installation and maintenance require qualified personnel. Production costs are substantial.

The invention proposes a hydraulic motor of this type, of improved concept and notable in particular for the simplicity of the means which ensure the control function.

More particularly, the invention relates to a hydraulic motor of the type comprising a casing through which passes a rotating shaft coupled by movement conversion means to an alternating rectilinear displacement piston, capable of movement inside the said casing and mounted so as to slide along the length of the said shaft, the said piston defining in the said casing first and second chambers alternately fed with fluid under pressure, characterised in that it comprises an inverter installed in the interior of the said casing and comprising three coaxial elements with axis parallel to that of the said rotating shaft and mounted so as to slide and/or turn in a manner such as to be sealed in relation to one another:

A first sleeve formed as one piece with the piston and extending into the said first chamber, A second sleeve, fixed in position, formed as one piece with a wall at the end of the casing and extending across the said second chamber and the said first sleeve, up to the said first chamber, A distributor extending between the two chambers and mounted such as to rotate in the interior of the said second sleeve, and in that the said inverter further comprises:

Conduit and hole elements suitable for controlling and switching the circulation of the actuating fluid, arranged between the second sleeve and the distributor, in order to control alternately and sequentially the filling of one chamber and the emptying of the other, depending on the said distributor occupies such or such a predetermined position among several defined by the interaction of the said coaxial elements, and Means for controlling the rotation of the said distributor, as a function of the displacement of the said sleeve locked with the piston.

Advantageously, the means of control comprise longitudinal ramps and stops, arranged at the free ends of the said first and second sleeves. A lateral lug is fitted so as to be movable in a longitudinal aperture of the distributor and interacts with the said ramps and stops by being placed under elastic tension in relation to them.

The invention will be better understood and other advantages become more clearly apparent in the light of the following description of a hydraulic motor in accordance with its principle, provided solely by way of example and making reference to the appended drawings, in which:

FIG. 1 is a perspective view with partial exposure of a hydraulic motor according to the invention;

FIG. 2 is a detailed view illustrating the rotating shaft;

FIG. 3 is a detailed view illustrating a first sleeve of the inverter;

FIG. 4 is a detailed view illustrating a second sleeve of the inverter;

FIGS. 5 and 6 are detailed views illustrating the distributor forming part of the inverter;

Figure 8:
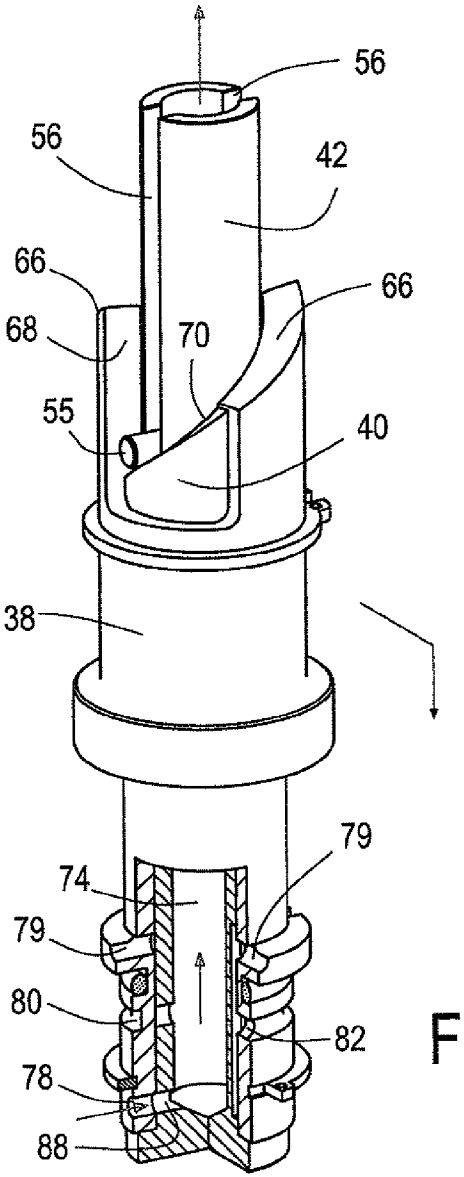
FIG. 8 to 11 are perspective views with partial exposure of the inverter in different states, to illustrate its function.
Figure 7:
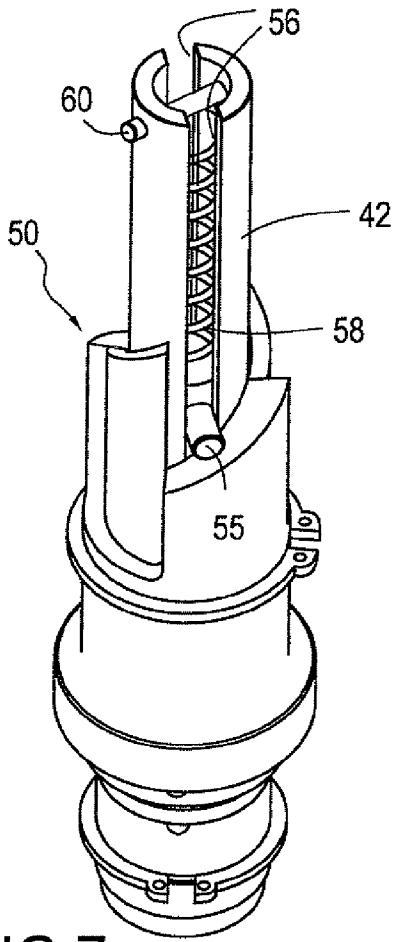
FIG. 7 represents a perspective view of the assembled inverter.
Figure 11:
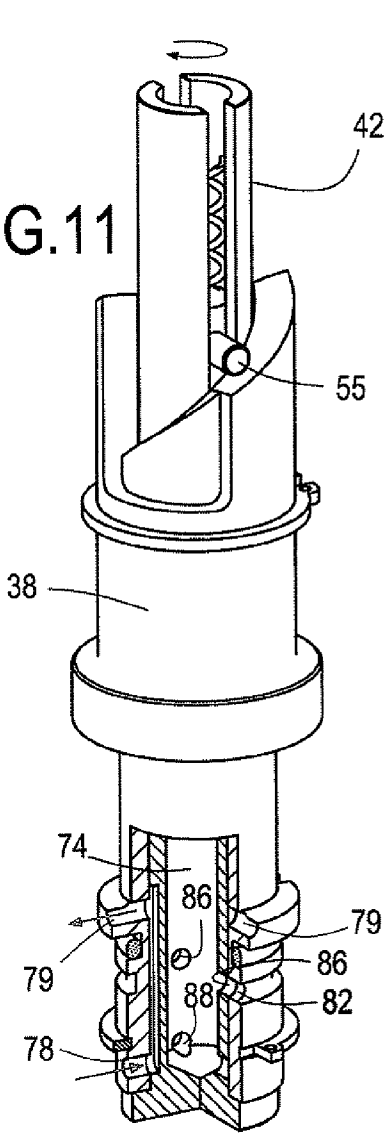

The hydraulic motor 11 represented is more particularly adapted to be used with a device for the continuous filtering of a hydraulic fluid such as oil. In an inherently known manner, the filtering device comprises means of automatic backblowing, requiring the continuous rotation of an isolating system, in order to take out of the circuit and isolate a sector of the filter. This sector is cleaned by counter-flow circulation. It is therefore advantageous to have available a hydraulic motor which uses, for its rotational displacement, a small part of the filtered fluid, under pressure. This is what enables the invention.

The hydraulic motor is of the type comprising a casing 12 through which passes a rotating shaft 13 of axis Y, retained between bearings 14, 16 defined in two parallel end walls 18, 20. The casing 12 also comprises a cylindrical wall 22 extending between the two end walls. A piston 24 slides in a sealed manner, thanks to exterior joints 25 and interior joints 26 along the length of the internal face of the cylindrical wall 22 of the casing 12 and along the length of the surface of the shaft 13.

The piston 24 therefore separates the internal space of the casing 12 into a first chamber 28 (the upper chamber when viewing FIG. 1) and a second chamber 29 (the lower chamber) alternately fed with fluid under pressure by an inverter 30, which will be described hereinafter.

The alternating feeding of the two chambers 28, 29 renders the movement of the piston rectilinear and alternating, with automatic inversion of the direction of displacement when the piston reaches one of the two end positions.

In addition, the piston 24 comprises two opposed lugs 32, emerging radially towards the interior and engaged in a circumferential corrugated throat 34, sunken at the outer surface of the said shaft 13 in a portion of its greatest diameter.

Accordingly, the rectilinear alternating displacement of the piston 24 is transformed by a practically continuous rotational actuation, in the same direction of the rotating shaft 13. The implementation of this type of movement conversion is independent of the structure of the inverter, which will be described hereinafter. This type of motor can be adapted to accommodate any system of inversion by pressure, such as control by sensor-actuated electric valves, or any other system of the same function.

The inverter 30 is notable for its simplicity, using a minimal number of parts, and is easy to assemble and install. It is easy to maintain since it is possible to dismantle the entire device from the base, the wall 18 being removable.

According to an important characteristic of the invention, the inverter 30 is installed in the interior of the casing 12 and comprises three coaxial elements, of axis X-X parallel to that of the said rotating shaft 13 and mounted so as to slide and/or rotate, with contact with one another in a sealed manner, in order to set one or the other of the chambers 28, 29 in successive and alternating communication with an actuating fluid under pressure. These elements are defined as follows:

- A first sleeve 38 is formed as one piece with the piston 24 and extends into the said first chamber 28,
- A second sleeve 40, fixed in position, is formed as one piece with a wall at the end of the casing (the wall 18) and extends across the said second chamber 29 and the said first sleeve, up to the said first chamber 28. It accordingly opens into the said first chamber in the interior of the said first sleeve.
- A distributor 42, also in the form of a sleeve, according to the example, extends between the two chambers. It is mounted so as to rotate in the interior of the second sleeve 40. The first sleeve slides in a sealed manner, i.e. it rubs gently in the exterior of the second sleeve, while the distributor 42 is mounted in a sealed manner in the second sleeve with the possibility of rotation around the axis XX common to the three elements.

The inverter 30 comprises conduit and hole elements suitable for controlling and switching the circulation of the actuating fluid. They are arranged between the second sleeve 40 and the distributor 42, in order to control alternately and sequentially the filling of one of the chambers by fluid under pressure and the simultaneous emptying of the other chamber. The chamber put under pressure is selected according to whether the said distributor 42 occupies such or such a predetermined (angularly) position among several, defined by the interaction between the sleeves 38, 40. In the example, the rotation of the distributor 42 between two successive predetermined positions is 90°.

In addition to this, the inverter 30 comprises means 50 for controlling the rotation of the said distributor 42 as a function of the displacement of the said first sleeve 38 formed as one piece with the piston.

In the example described, the said control means 50 comprise longitudinal ramps and stops, arranged at the free ends (in the said first chamber) of the said first and second sleeves. In addition, a lateral lug 55 is installed in a movable manner in a longitudinal hole of the said distributor 42. It interacts with these longitudinal ramps and stops by being placed under elastic tension in relation to them.

It should be noted that the first sleeve 38 comprises two wide notches which define the stops 68 while the second sleeve 40 also comprises two wide notches which define the stops 72. The thickness of the wall of the first sleeve is greater along the length of the stops 68 than that of the second sleeve, in such a way that along the length of these stops the two sleeves are in contact with the surface of the distributor 42. The two sleeves are interlinked with one another without the possibility of one rotating in relation to the other.

According to the example, a spring 58 is mounted in the interior of the said distributor 42 between a stop 60 of the distributor 42 and the said lateral lug 55, in order to push the lug back towards the longitudinal ramps and stops.

Very preferably, the lug 55 is double and extends diametrically at the outlet, across a double aperture 56 of the distributor, longitudinally, from one side and the other of the latter. In addition to this, the said first and second sleeves each comprise two longitudinal ramps and stops as referred to heretofore.

More particularly, the said first sleeve 38 comprises, at its free end, two opposed and symmetrical ramps 66 (in relation to the axis of rotation XX), as well as two longitudinal stops 68 referred to heretofore.

In an analogous manner, the said second sleeve 40 comprises at its free end two opposed and symmetrical ramps 70 (in relation to the axis) as well as two longitudinal stops 72 referred to heretofore. The ramps have the same pitch, and the slide path between the two sleeves is such that one ramp of the said first sleeve can enter into the extension of a ramp of the said second sleeve, as will be seen in detail hereinafter.

It is clear that the role of the distributor is to direct the flow of the actuating fluid, which is the reason why it comprises in particular an axial conduit 74 establishing the communication with the said first chamber 28. This does not involve an open sleeve, however, since its end on the side opposite the said first chamber is closed. The double lug 55 comprises in its centre a part which forms a guide sliding along the length of the axial conduit 74 of the distributor 42, but without obstructing it. On the other hand, the conduit communicating with the first chamber is not necessarily axial.

According to the example, the conduit and hole elements suitable for controlling and switching the circulation of the fluid are divided between the second sleeve 40 and the distributor 42.

More particularly, according to this example, the said second sleeve 40 comprises at its base a radial hole 78, in communication on the outside, with an inlet for actuating fluid under pressure. It also comprises four radial holes 79 displaced by 90° and opening into the said second chamber 29. The second sleeve 40 further comprises an outer throat 80 in a part located in the thickness of the end wall 18. This throat defines, with the said end wall, an annular conduit in communication externally with an outlet for the actuating fluid to be drained.

The throat is pierced by two radial holes 82, diametrically opposed.

In addition to this, the distributor comprises two longitudinal slots 84, sunk onto its external face, diametrically opposed and extending from the top of the hole 78 up to that of the holes 79. It also comprises two diametrically opposed radial holes 86, located at a level allowing them to communicate with the holes 80, for certain predetermined angular positions of the distributor. This latter also comprises two diametrically opposed radial holes 88, located at a level allowing them to communicate with the hole 78. The holes 86 and 88 are in the same plane but offset by 90° in relation to the slots 84.

Figure 10:
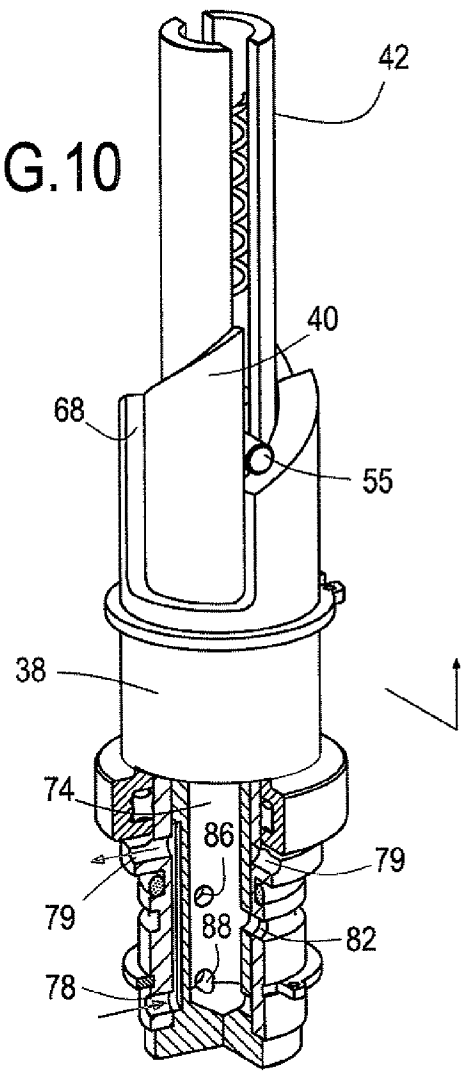

Accordingly, the supply of the second chamber 29 with fluid under pressure is effected as shown in FIG. 10, by putting the hole 78, receiving the fluid under pressure, in correspondence with a longitudinal rib 84 of the distributor extending up to opposite a hole 79 opening into the second chamber.

Figure 9:
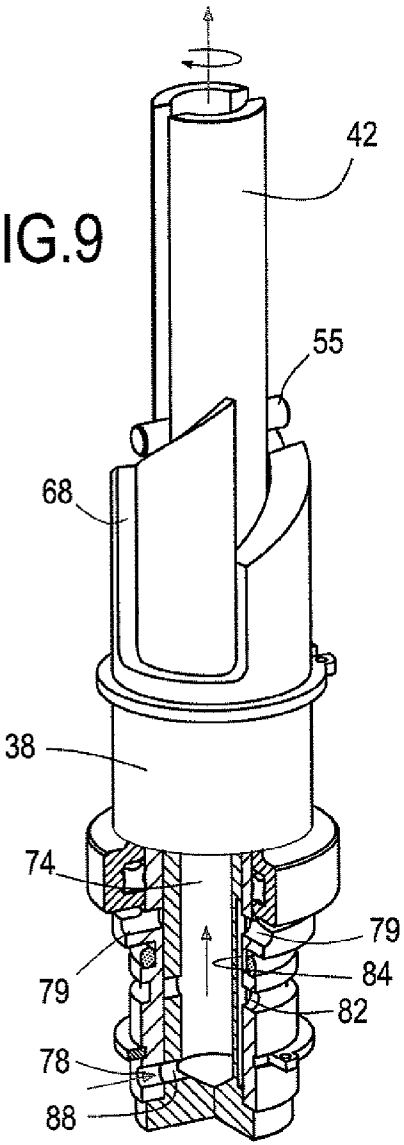

Inversely, the emptying of the second chamber takes place in another predetermined position by bringing into correspondence a hole 79 located in the second sleeve with a longitudinal slot 84, itself in correspondence with a hole 82 located at the base of the throat 80 connected to the outlet of actuating fluid (see FIG. 9).

With regard to the said first chamber, this is put under pressure by bringing the hole 78 in correspondence with a hole 88 located in the distributor and which opens into the axial conduit 74 thereof. This axial conduit opens into the first chamber 28 (see FIG. 9).

In another position of the distributor, offset by 90°, the fluid from the first chamber flows back by passing through the axial conduit 74 up to a hole 86 brought into correspondence with another hole 82 which opens at the base of the throat 80 of the second sleeve (see FIG. 10).

The function of the inverter will now be explained by reference to FIGS. 8 to 11.

In FIG. 8, the piston is assumed to be in the upper position regarding FIG. 1, i.e. the first chamber 28 is at its minimum volume. Under these conditions the two ramps of the first sleeve 38 rise over the ramps of the second sleeve 40, two by two. In addition, as can be seen, one ramp 70 of the second sleeve 40 extends towards the base of the corresponding ramp 66 of the first sleeve 38. The lug 55, under tension from the spring 58 is blocked between the lower ends of the ramps 70 of the second sleeve and the adjacent longitudinal surfaces 68 of the first sleeve. The distributor 42 is therefore in a well-determined angular position in relation to the second sleeve, and, in this position, the holes and conduit elements defined heretofore put the first chamber 28 in communication with the fluid under pressure and allow for the draining of the second chamber 29. The piston then begins to descend, actuating the first sleeve 38. During the whole of this movement of the piston, the angular position of the distributor 42 does not change.

In addition to this, the displacement of the piston sets the shaft in rotation by interaction of the lugs 32 of the piston with the throats 34 of the shaft.

When the piston reaches its lower position (FIG. 9), the ramps 66 of the first sleeve arrive in the lower extension of the ramps 70 of the second sleeve. Consequently, under the tension of the spring 58, the distributor turns through 90° until the lug 55, supported on the ramps of the first sleeve, comes in contact with the longitudinal stops 72 of the second sleeve. At the end of this rotation (FIG. 10), the distributor is in another predetermined position, by which the fluid under pressure is applied to the second chamber 29, while the first chamber 28 can be emptied. As from that moment, the piston rises again, setting the shaft 13 in rotation in the same direction. At the end of the path of the piston rising again, the said first sleeve again rises over the second sleeve, as in the configuration illustrated in FIG. 8, and the distributor can again rotate by a quarter of a turn (FIG. 11) in order to invert the distribution of the fluid under pressure.

The invention claimed is:

1. A hydraulic motor of the type comprising a casing through which passes a rotating shaft coupled by a movement conversion means to an alternating rectilinear displacement piston, capable of movement inside the casing and mounted so as to slide along the length of the shaft, the piston defining in the casing first and second chambers alternately fed with fluid under pressure, an inverter installed in the interior of the casing and comprising three coaxial elements with axes parallel to that of the rotating shaft and mounted so as to slide and/or turn in a manner such as to be sealed in relation to one another;

a first sleeve formed as one piece with the piston and extending into the first chamber;

a second sleeve, fixed in position, formed as one piece with a wall at an end of the casing and extending across the second chamber and the first sleeve, up to the first chamber; and a distributor extending between the two chambers and mounted such as to rotate in the interior of the second sleeve;

wherein the inverter further comprises conduit and hole elements suitable for controlling and switching the circulation of the actuating fluid, arranged between the second sleeve and the distributor, in order to control alternately and sequentially the filling of one chamber and the emptying of the other, depending on whether the distributor occupies such or such a predetermined position among several defined by the interaction of the coaxial elements, and control means for controlling the rotation of the distributor as a function of the displacement of the sleeve locked with the piston.

2. The hydraulic motor according to claim 1, wherein the control means comprise longitudinal ramps and stops, arranged at free ends of the first and second sleeves, and wherein a lateral lug, fitted so as to be movable in a longitudinal aperture of the distributor as it interacts with the ramps and stops, is placed under elastic tension in relation to them.

3. The hydraulic motor according to claim 2, further including a spring mounted in the distributor between one of its stops and the lateral lug to push the lug towards the longitudinal ramps and stops.

4. The hydraulic motor according to claim 2, wherein the lug extends diametrically outwards on one side and the other of the distributor and wherein the first and second sleeves each comprise two of said longitudinal ramps and stops.

5. The hydraulic motor according to claim 4, wherein the first sleeve comprises at its free end two opposed and symmetrical ramps, defining between them the longitudinal stops.

6. The hydraulic motor according to claim 4, wherein the second sleeve comprises at its free end two opposed and symmetrical ramps, defining between them the longitudinal stops.

7. The hydraulic motor according to claim 1, wherein the piston comprises at least one lug emerging radially towards the interior and engaged in a corrugated circumferential throat, sunken at the outer surface of the shaft.

* * * * *